US005677008A

United States Patent [19]

Kameya et al.

[11] Patent Number: 5,677,008

[45] Date of Patent: Oct. 14, 1997

[54] CONTINUOUS COATING METHOD FOR COATING MATERIAL WITH INSUFFICIENT FLUIDITY

[75] Inventors: Toru Kameya, Chiba; Kiyoshi Kasai, Funabashi; Yukikatsu Ito, Chiba; Yuji Aoyama, Ichihara, all of Japan

[73] Assignee: Taiyo Steel Co., Ltd., Tokyo, Japan

[21] Appl. No.: 553,513

[22] PCT Filed: Apr. 28, 1994

[86] PCT No.: PCT/JP94/00729

§ 371 Date: Dec. 22, 1995

§ 102(e) Date: Dec. 22, 1995

[87] PCT Pub. No.: WO95/29768

PCT Pub. Date: Nov. 9, 1995

[51] Int. Cl.[6] ..... B05D 1/28

[52] U.S. Cl. ..... 427/428; 118/262; 118/249

[58] Field of Search ..... 427/428; 118/249, 118/262

[56] References Cited

U.S. PATENT DOCUMENTS 4,485,132 11/1984 Furuzono et al. ..... 427/428
4,796,559 1/1989 Lohse ..... 118/262

FOREIGN PATENT DOCUMENTS 57-4264 1/1982 Japan .
58-37874 8/1983 Japan .
5-138098 6/1993 Japan .

OTHER PUBLICATIONS

Abstract of Japan Applicatn No. 78/907 (30 Jan. 1978), chemical Abstracts, vol. 92 1980, p. 72.

*Primary Examiner*—Katerine A. Bareford
*Attorney, Agent, or Firm*—Kanesaka & Takeuchi

[57] ABSTRACT

In a continuous coating method, a coating material with insufficient fluidity can be uniformly coated on a substrate. A pick-up roller is disposed between a coating roller and a metering roller and a doctor bar is located above the pick-up roller. The coating roller is located near the substrate. The pick-up roller is rotated in a direction to pick-up the coating material through a gap between the pick-up roller and the metering roller. The metering roller is rotated in the same direction as the pick-up roller at a nip of these rollers, and the coating roller is rotated in a reverse direction with respect to the pick-up roller at a nip of these rollers. The substrate travels in a reverse direction with respect to the coating roller at a nip thereof. In the method, the pick-up roller picks up the coating material through the gap between the pick-up roller and the metering roller, and a meniscus of the coating material is formed between the pick-up roller and the metering roller while the pick-up roller and the metering roller are rotating. Thus, a uniform coating film is formed on the pick-up roller, which is transferred to the substrate through the coating roller.

3 Claims, 2 Drawing Sheets

CONTINUOUS COATING METHOD FOR COATING MATERIAL WITH INSUFFICIENT FLUIDITY

This is a national stage of PCT JP94/00729, filed Apr. 28, 1994.

TECHNICAL FIELD

The present invention relates to a reverse roller coater for continuous coating on strips such as metal strips such as galvanized steel sheets, aluminum sheets, or the like, or strips such as plastic films or papers, and in particular, relates to a reverse roller coater which is capable of coating special coating materials which were difficult to coat by using conventional methods.

BACKGROUND ART

A two-roller reverse roller coater such as that shown in FIG. 1 or a three-roller reverse roller coater such as that shown in FIG. 2 were used in methods for uniformly and efficiently coating coating materials on the surface of a continuous strip such as a metal strip such as galvanized steel sheet, an aluminum sheet, or the like, or strips such as plastic films or paper. However, when a coating material which was not suitable for roller coating was coated by using such a method, a roping pattern occurred in the coating surface and the uniformity of the coating film was lost, and the appearance of the surface was adversely affected and the corrosion resistance and color tone stability were also adversely affected. What is meant by "coating materials which lack suitability for roller coating" are coating materials which lack the so-called "flowability", such as coating materials having a strikingly high viscosity, such as vinyl chloride-type sol coating materials or synthetic rubber-type coating materials, low-gloss coating materials containing large amounts of extender pigment, or coating materials having high thixotropy which contain organic pigments or metallic powders having a large particle diameter, or the like.

What is meant by a "roping pattern" is a pattern in which the coating surface possesses irregularities shaped like liquid striations; this is generated when the coating material assumes a torn state when being transferred from roller to roller, and is transferred in that state to the coating surface; in FIG. 1, this occurs between the pick-up roller and the coating roller, while in FIG. 2, it occurs between the metering roller and the pick-up roller.

In Japanese Patent No. 1481172 (Feb. 10, 1989), the present inventor has proposed a method for solving this problem, wherein, as shown in FIG. 3, a doctor bar is disposed at the pick-up roller. By means of this invention, the torn state of the coating material between the rollers does not occur, and the roping phenomenon is avoided. After this, the present inventor coated a coating material having poor suitability for roller coating in a smooth manner and with high productivity by means of the method of the present invention.

In recent years, pre-coated metal (hereinbelow abbreviated to PCM) has come to be employed, not merely in the construction industry, but in a number of manufacturing industries such as the consumer electronics industry, the automobile industry and the like. In accordance with this, the performance requirements have increased sharply, and requirements relating to an increase in physical performance, such as superior workability and high coating film hardness, and requirements related to external appearance, such as high gloss, high reflectivity, complete delustering tone, and the like, have also increased. In order to respond to these demands, new resins have been developed for coating materials for use in PCM, and various additives have been developed. In particular, in order to provide both workability and coating film hardness, coating materials have been developed which employ polymeric polyester resins or urethane resins as a base.

Furthermore, in order to increase the metallic film hardness, or in order to meet demands relating to external appearance characteristics, various resinous additives or inorganic additives have come to be employed. Coating materials have also been developed in which the solvent present in the coating material is reduced, or in which the coating material is made aqueous and no solvent is employed, for the purposes of environmental preservation and conservation of resources.

It is of course the case that these coating materials which have been developed in recent years have coating characteristics which differ from those of conventional PCM coating materials. Discussed with respect to suitability for roller coating, these are as follows.

(1) Coating materials having poor pick-up characteristics

When the coating material is lifted from the coating material pan by the pick-up roller, a phenomenon occurs in which the coating material does not adhere uniformly to the surface of the roller, and irregularities develop. Accordingly, the thickness of the coating film fluctuates, and color irregularities are generated. This phenomenon is particularly likely to occur when the peripheral speed of the pick-up roller is low. This phenomenon is also particularly likely to occur with polymeric polyester coating materials and urethane coating materials.

(2) Coating materials having high thixotropy

When coating materials which are likely to cause the occurrence of the roping pattern described above are employed, a phenomenon occurs in which the irregularities which are generated on the surface of the coating film do not level out, since the flowability of the coating materials is poor, and harden in an undesirable manner. This is particularly likely to occur with sol-type coating materials such as vinyl chloride resins or fluorine resins or the like, or with aqueous acrylic emulsion coating materials and coating materials to which large amounts of aggregate or pigment are added in order to obtain a delustered external appearance.

(3) Coating materials having a high viscosity

When reverse-roller coating is carried out, if the coating material has a high viscosity, it is difficult to control the thickness of the coating film and it is difficult to obtain a thin film thickness. This is because when the coating material is transferred from the pick-up roller to the coating roller, it is difficult to force the coating material into a thin state by means of the pressure of the roller. Moreover, the roping pattern is also likely to occur, as the flowability is poor. For this reason, the viscosity of the coating material is commonly adjusted so as to be within a range of 40~80 seconds in a number 4 Ford cup (from 500 to 1200 centipoise in a type B viscometer). Since the initial viscosity of the coating material is normally within a range of from 160 to 200 seconds, and from 1500~2000 cps, this is diluted by using a solvent.

From the point of view of savings in natural resources, if coating can be achieved without dilution by means of a solvent, the advantages, both in terms of the environment and of costs, are so large as to be immeasurable.

When the coating of coating materials having poor roller suitability as described above is conducted by using a reverse roller coater in accordance with the conventional technology shown in FIG. 3 which was developed by the present inventor, that is to say, a reverse roller coater in which a doctor bar is disposed at the pick-up roller, the following problems occur.

1) When the coating of a coating material having poor pick-up characteristics is carried out, color irregularities occur. If the rotation of the pick-up roller is speeded up, this problem disappears; however, the thickness of the coating film increases and cannot be controlled.

2) When a coating material having high thixotropy, and in particular, a coating material into which pigment or aggregate having a large size is mixed, is coated, linear coating film flaws are likely to appear in the coating surface.

3) When a coating material having high thixotropy and a coating material having high viscosity are coated, striped-shaped irregularities occur in the coating surface. If the rotation of the pick-up roller is speeded up, this problem disappears; however, the thickness of the coating film increases and cannot be controlled.

SUMMARY OF THE INVENTION

The present inventor has investigated the causes of these problems by means of experimentation and observation at actual manufacturing facilities, and has come to hold the following opinions. That is to say:

1) The color irregularities generated when coating a coating material having poor pick-up characteristics occur because the coating material lifted from the coating material pan exhibits irregularities on the pick-up roller surface, and these irregularities pass through the gap with the doctor bar in an unchanged manner.

Accordingly, it is believed that if a sufficient coating material could be supplied in a constantly stable manner between the pick-up roller and the metering roller, the irregularities on the roll surface would disappear, a uniform coating film would be formed in time at which the film passes the doctor bar, and the color irregularities would be eliminated.

2) When a coating material is used to which pigment, Al powder, aggregate or the like having a large size has been added, linear coating film flaws are liable to occur, and when coating film flaws occur, momentary gaps open, and when the original gap is returned to, the flaws are eliminated; however, after a short period of time, flaws occur again. The cause of these flaws was found to lie in the fact that since the large pigment, Al powder, aggregate or the like present in the coating material is not evenly taken up by the pick-up roll, this is concentrated in a localized manner and thereby is caught in the gap between the doctor bar and the pick-up roll.

Accordingly, a conception was reached in which by means of forming a sufficient coating material meniscus between the pick-up roller and the metering roller, the large pigment, Al powder, aggregate or the like present in the coating material is uniformly distributed within the meniscus, and thus coating can be carried out without catching the substances in the gap between the doctor bar and the pick-up roller.

3) The striped-shaped irregularities occurring during the coating of a coating material having high thixotropy or a coating material having high viscosity were determined to occur in the following manner. When the coating material is taken up by the pick-up roller, the coating material is not picked up in a uniform and flat manner, so that the coating material on the surface of the pick-up roller is in an uneven state, and after passage through the gap between the doctor bar and the pick-up roller, the uneven state of the coating material produces striped-shaped color irregularities.

Accordingly, it is thought that the unevenness in the coating material on the surface of the pick-up roller can be eliminated by means of forming a sufficient coating material meniscus between the pick-up roller and the metering roller, and thus a coating film free of striped-shaped irregularities can be obtained.

Based on these observations, the present inventor inferred that it would be possible to eliminate irregularities in pick-up, coating film flaws, and striped-shaped irregularities by means of forming a sufficient coating material meniscus between the pick-up roller and the metering roller, even when a coating material having poor pick-up characteristics, a coating material to which pigment, Al powder, aggregate or the like having a large size had been added, a coating material having poor thixotropic characteristics, and coating material having high viscosity were employed.

The present inventor developed the equipment and method and, the essence of the present invention is:

a continuous coating method in which a coating material present in a coating material pan is caused to pass through a gap between a doctor bar which is disposed above a pick-up roller and the pick-up roller, a coating film is formed on the pick-up roller, a portion or almost all of the coating material on the pick-up roller is then transferred to the surface of a coating roller rotating in a reverse manner with respect to the pick-up roller, and a portion or almost all of the coating material on the coating roller is transferred to a substrate surface which is moved in a direction opposite to the direction of rotation of the coating roller, wherein a metering roller which rotates in the same direction as the pick-up roller is disposed in close proximity to the pick-up roller, and a coating material meniscus is formed between the pick-up roller and the metering roller.

One characteristic of the present invention is that a meniscus is formed between the pick-up roller and the metering roller, which is disposed in close proximity thereto. By means of forming a meniscus at this position, the coating material which is taken up from the coating material pan does not enter a state in which irregularities are present in the distribution on the surface of the pick-up roller, and the coating material is thus made uniform, and it is possible to obtain a satisfactory coating film with any of the coating materials having poor roller coating characteristics which are described above, and thus a method is ensured by which the continuous coating of a wide range of coating materials can be conducted with an identical equipment.

The amount of meniscus should be such as to constantly have at least 1.5 times relative to the amount of a coating material passing through the gap between the doctor bar and the pick-up roller.

The rotational speed of the pick-up roller and the rotational speed of the metering roller, as well as the gap between the pick-up roller and the metering roller, may be adjusted in order to form the meniscus, although this depends on the type of a coating material.

The amount of the meniscus increases as the rotational speed of the pick-up roller is increased or as the rotational speed of the metering roller is decreased, or as the gap with the pick-up roller is made larger.

It is preferable that the gap between the pick-up roller and the metering roller be made constant, and the rotational speed of the pick-up roller be set within a range of 1.0~2.5 times relative to the strip passage speed, and that the amount of meniscus be controlled by means of adjusting the rotational speed of the metering roller.

DETAILED DESCRIPTION OF A PREFERRED EMBODIMENT

Figure 1:
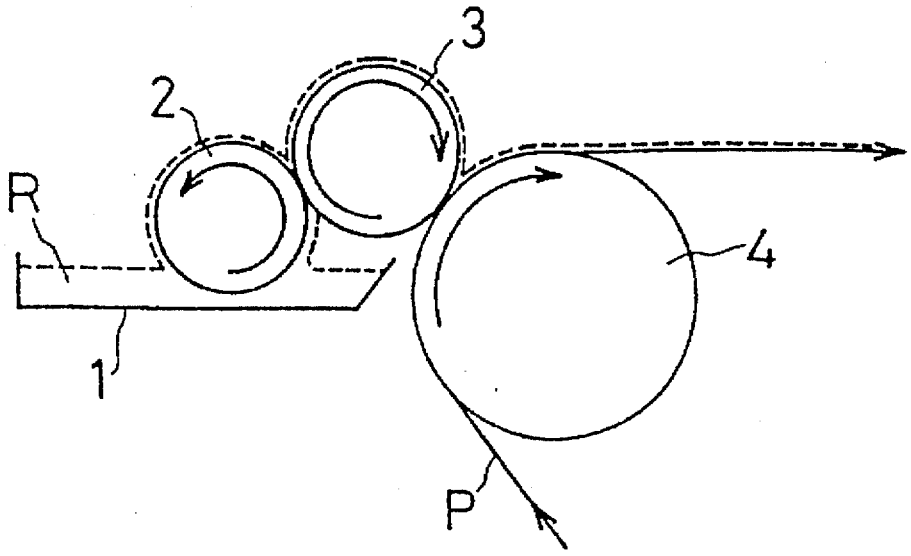
Fig. 1 Prior Art
FIG. 1 is an explanatory diagram of a conventional reverse-roller coater employing two rollers.

In the Figures, reference numerals 1 and 7 indicate coating material pans, reference numerals 2 and 8 indicate pick-up rollers, reference numerals 3 and 10 indicate coating rollers, reference numerals 4 and 11 indicate back-up rollers, reference numerals 5 and 12 indicate metering rollers, reference numeral 9 indicates a doctor bar, reference P indicates a substrate, reference R indicates a coating material, and reference T indicates a meniscus.

In the invention, the coating roller 10 is travelling in a reverse direction with the pick-up roller 8 at the nip of the two rollers, while the coating roller 10 is travelling in the opposite direction with regard to the substrate P at the nip of the two elements. The metering roller 12 is rotating in the same direction of the pick-up roller at the nip of the two rollers.

Experiments were carried out by using the equipment shown in FIG. 4 for executing the present invention, while varying the conditions as shown below, and the external appearances of the coatings (color irregularities, roping, linear flaws, linear irregularities) were surveyed, and the results thereof are shown in the Tables by Embodiment.

1) Gap between the pick-up roller and the doctor bar

After a fixed gap was set, adjustment to pre-determined gaps was made in micron units by means of a magne-scale.

2) Amount of meniscus on the doctor bar entry side

The presence or absence of a meniscus was visually confirmed.

3) Type of coating material

A polymeric polyester-type coating material was selected as a coating material having poor pick-up characteristics, and a vinyl chloride plastisol-type coating material to which an aggregate was added was selected as a coating material having poor thixotropy and a coating material having high viscosity.

4) Coating material viscosity

The viscosity of the coating materials was adjusted by dilution of the sample coating materials with a solvent, and these were measured using a number No. 4 Ford cup or a type B viscometer.

5) Coating material TI value (thixotropic index)

The ratio of the viscosity after 6 revolutions in a type B viscometer to the viscosity after 60 revolutions was measured.

6) Coating material thixotropy

The lamellar length in the coating material during coating was measured.

7) Strip passage speed of the substrate

The speed in a coating line in which an apparatus in accordance with the present invention was incorporated was adjusted in accordance with actual production speed. It is displayed in terms of M/minute.

8) Rotational speed of each roller

The rotational speed of the rollers was adjusted by means of direct current motors, and the circumferential speed of each roller was determined from the diameter thereof and thus set.

Embodiments of the method of the present invention and Comparative Examples in accordance with conventional methods are shown in Tables 1 through 4.

The coating apparatuses employed in each example have the composition shown in FIGS. 1, 2, 3, or 4, and the Figure numbers are displayed in the "coating apparatus" column in each Table. The characteristics of the coating materials used and the coating conditions are as noted in the Tables.

TABLE 1

COATING MATERIAL EMPLOYED: COATING MATERIAL HAVING POOR PICK-UP CHARACTERISTICS (LAMELLAR LENGTH: 0.3 mm)

Figure 2:
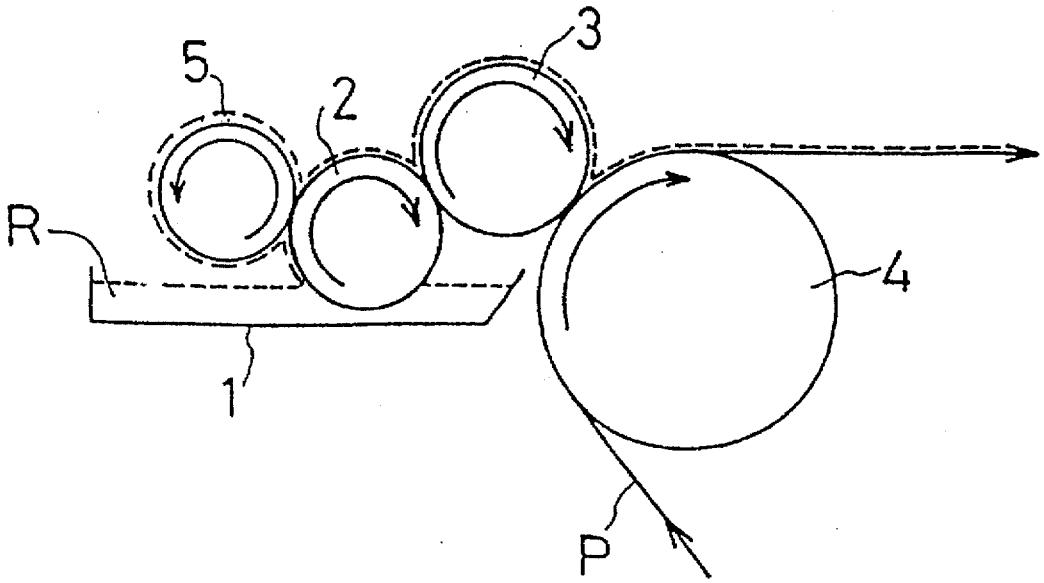
Fig. 2 Prior Art
FIG. 2 is an explanatory diagram of a conventional reverse-roller coater employing three rollers.
Figure 3:
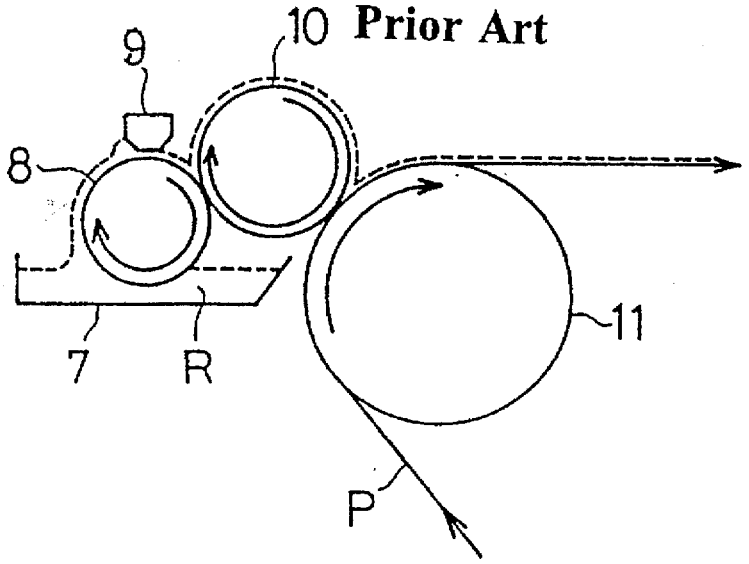
FIG. 3 is an explanatory diagram of a reverse-roller coater having a doctor bar installed therein in accordance with Japanese Patent No. 1481172.
Figure 4:
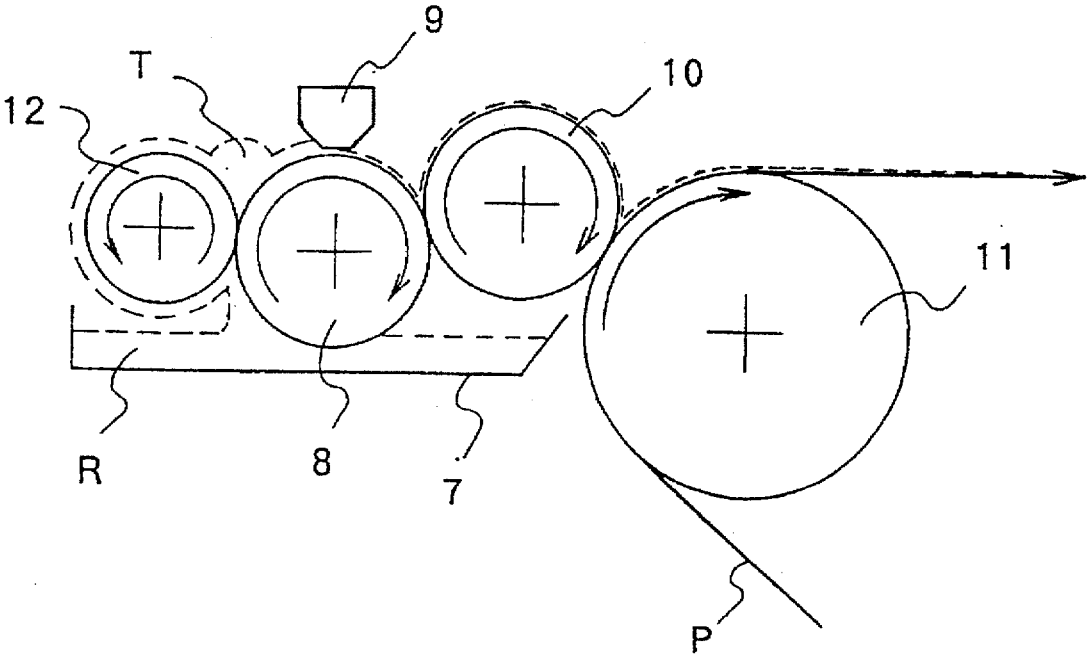
FIG. 4 is an explanatory diagram of a reverse-roller coater using a method of the present invention.

| | COATING MATERIAL TYPE | GLOSS | TARGET DESSICATED FILM THICKNESS μ | COATING MATERIAL VISCOSITY (Sec) | TI VALUE | PIGMENT PARTICLE DIAMETER μ | ① STRIP PASSAGE SPEED m/min | COATING APPARATUS | ② COATING ROLLER PERIPHERAL SPEED m/min | ② COATING ROLLER PERIPHERAL SPEED RATIO ② ÷ ① | ③ PICK-UP ROLLER PERIPHERAL SPEED m/min | ③ PICK-UP ROLLER PERIPHERAL SPEED RATIO ③ ÷ ① |
|---|---|---|---|---|---|---|---|---|---|---|---|---|
| EMBODIMENT 1 | POLYMERIC POLYESTER | 80 | 20 | 40 | 1.1 | 1.5 | 60 | FIG. 4 | 84 | 1.4 | 96 | 1.6 |
| EMBODIMENT 2 | POLYMERIC POLYESTER | 80 | 20 | 80 | 1.1 | 1.5 | 60 | FIG. 4 | 84 | 1.4 | 96 | 1.6 |
| EMBODIMENT 3 | POLYMERIC POLYESTER | 80 | 20 | 80 | 1.1 | 1.5 | 60 | FIG. 4 | 78 | 1.3 | 90 | 1.5 |
| EMBODIMENT 4 | POLYMERIC POLYESTER | 80 | 20 | 80 | 1.1 | 1.5 | 60 | FIG. 4 | 72 | 1.2 | 84 | 1.4 |
| EMBODIMENT 5 | POLYMERIC POLYESTER | 80 | 20 | 130 | 1.1 | 1.5 | 60 | FIG. 4 | 72 | 1.2 | 84 | 1.4 |
| EMBODIMENT 6 | POLYMERIC POLYESTER | 80 | 20 | 130 | 1.1 | 1.5 | 60 | FIG. 4 | 72 | 1.2 | 84 | 1.4 |
| EMBODIMENT 7 | POLYMERIC POLYESTER | 80 | 20 | 130 | 1.1 | 1.5 | 60 | FIG. 4 | 84 | 1.4 | 96 | 1.6 |
| COMPARATIVE EXAMPLE 1 | POLYMERIC POLYESTER | 80 | 20 | 80 | 1.1 | 1.5 | 60 | FIG. 3 | 72 | 1.2 | 40 | 0.8 |
| COMPARATIVE EXAMPLE 2 | POLYMERIC POLYESTER | 80 | 20 | 130 | 1.1 | 1.5 | 60 | FIG. 3 | 72 | 1.2 | 84 | 1.4 |
| COMPARATIVE EXAMPLE 3 | POLYMERIC POLYESTER | 80 | 20 | 130 | 1.1 | 1.5 | 60 | FIG. 3 | 72 | 1.2 | 120 | 2.0 |
| COMPARATIVE EXAMPLE 4 | POLYMERIC POLYESTER | 80 | 20 | 80 | 1.1 | 1.5 | 60 | FIG. 1 | 72 | 1.2 | 84 | 1.4 |
| COMPARATIVE EXAMPLE 5 | POLYMERIC POLYESTER | 80 | 20 | 80 | 1.1 | 1.5 | 60 | FIG. 1 | 72 | 1.2 | 100 | 1.7 |
| COMPARATIVE EXAMPLE 6 | POLYMERIC POLYESTER | 80 | 20 | 130 | 1.1 | 1.5 | 60 | FIG. 1 | 72 | 1.2 | 84 | 1.4 |
| COMPARATIVE EXAMPLE 7 | POLYMERIC POLYESTER | 80 | 20 | 80 | 1.1 | 1.5 | 60 | FIG. 2 | 72 | 1.2 | 84 | 1.4 |
| COMPARATIVE EXAMPLE 8 | POLYMERIC POLYESTER | 80 | 20 | 80 | 1.1 | 1.5 | 60 | FIG. 2 | 72 | 1.2 | 120 | 2.0 |
| COMPARATIVE EXAMPLE 9 | POLYMERIC POLYESTER | 80 | 20 | 130 | 1.1 | 1.5 | 60 | FIG. 2 | 72 | 1.2 | 84 | 1.4 |

| ④ METALING ROLLER PERIPHERAL SPEED m/min | ④ METALING ROLLER PERIPHERAL SPEED RATIO ④ ÷ ① | ⑤ GAP BETWEEN PICK-UP ROLLER AND DOCTOR BAR μ | PRESENCE/ABSENCE OF MENISCUS BETWEEN METALING ROLLER AND PICK-UP ROLLER | ACTUAL DESSICATED FILM THICKNESS μ | APPEARANCE OF COATED PRODUCT |
|---|---|---|---|---|---|
| 20 | 0.33 | 60 | PRESENT | 19 | SATISFACTORY |
| 20 | 0.33 | 45 | PRESENT | 21 | SATISFACTORY |
| 15 | 0.25 | 48 | PRESENT | 20 | SATISFACTORY |

TABLE 1-continued

| COATING MATERIAL EMPLOYED: COATING MATERIAL HAVING POOR PICK-UP CHARACTERISTICS (LAMELLAR LENGTH: 0.3 mm) | | | | | |
|---|---|---|---|---|---|
| 10 | 0.17 | 50 | PRESENT | 21 | SATISFACTORY |
| 15 | 0.25 | 45 | PRESENT | 20 | SATISFACTORY |
| 15 | 0.25 | 40 | PRESENT | 20 | SATISFACTORY |
| 5 | 0.08 | 35 | PRESENT | 19 | SATISFACTORY |
| — | — | 50 | ABSENT | 20 | COLOR IRREGULARITIES RESULTING FROM POOR PICK-UP CHARACTERISTICS |
| — | — | 50 | ABSENT | 24 | BUBBLING RESULTING FROM EXCESSIVE COATING FILM THICKNESS |
| — | — | 35 | ABSENT | 25 | BUBBLING RESULTING FROM EXCESSIVE COATING FILM THICKNESS |
| — | — | — | ABSENT | 20 | COLOR IRREGULARITIES RESULTING FROM POOR PICK-UP CHARACTERISTICS |
| — | — | — | ABSENT | 25 | BUBBLING RESULTING FROM EXCESSIVE COATING FILM THICKNESS |
| — | — | — | ABSENT | 23 | BUBBLING RESULTING FROM EXCESSIVE COATING FILM THICKNESS |
| 15 | 0.25 | — | ABSENT | 20 | COLOR IRREGULARITIES RESULTING FROM POOR PICK-UP CHARACTERISTICS |
| 15 | 0.25 | — | ABSENT | 24 | BUBBLING RESULTING FROM EXCESSIVE COATING FILM THICKNESS |
| 10 | 0.17 | — | ABSENT | 23 | BUBBLING RESULTING FROM EXCESSIVE COATING FILM THICKNESS |

TABLE 2

| COATING MATERIAL EMPLOYED: UNDILUTED COATING MATERIAL | | | | | | | | | | | | |
|---|---|---|---|---|---|---|---|---|---|---|---|---|
| | | | TARGET DESSICATED | COATING | | PIGMENT | ① STRIP | | ② COATING ROLLER | | ③ PICK-UP ROLLER | |
| | COATING MATERIAL TYPE | GLOSS | FILM THICKNESS μ | MATERIAL VISCOSITY (Sec) | TI VALUE | PARTICLE DIAMETER μ | PASSAGE SPEED m/min | COATING APPARATUS | PERIPHERAL SPEED m/min | PERIPHERAL SPEED RATIO ② ÷ ① | PERIPHERAL SPEED m/min | PERIPHERAL SPEED RATIO ③ ÷ ① |
| EMBODIMENT 1 | COMMON POLYESTER | 80 | 20 | 160 | 1.0 | 1.2 | 60 | FIG. 4 | 84 | 1.4 | 96 | 1.6 |
| EMBODIMENT 2 | COMMON POLYESTER | 50 | 20 | 160 | 1.1 | 1.5 | 60 | FIG. 4 | 84 | 1.4 | 96 | 1.6 |
| EMBODIMENT 3 | COMMON POLYESTER | 30 | 20 | 180 | 1.2 | 1.7 | 60 | FIG. 4 | 78 | 1.3 | 90 | 1.5 |
| EMBODIMENT 4 | COMMON POLYESTER | 10 | 20 | 200 | 1.4 | 2.0 | 60 | FIG. 4 | 72 | 1.2 | 84 | 1.4 |
| EMBODIMENT 5 | COMMON POLYESTER | 10 | 20 | 200 | 1.4 | 2.0 | 60 | FIG. 4 | 60 | 1.0 | 60 | 1.0 |
| EMBODIMENT 6 | POLYMERIC POLYESTER | 80 | 20 | 160 | 1.0 | 1.2 | 60 | FIG. 4 | 72 | 1.2 | 84 | 1.4 |
| EMBODIMENT 7 | POLYMERIC POLYESTER | 50 | 20 | 160 | 1.2 | 1.5 | 60 | FIG. 4 | 72 | 1.2 | 84 | 1.4 |
| EMBODIMENT 8 | POLYMERIC POLYESTER | 30 | 20 | 180 | 1.3 | 1.7 | 60 | FIG. 4 | 84 | 1.4 | 96 | 1.6 |
| EMBODIMENT 9 | POLYMERIC POLYESTER | 10 | 20 | 200 | 1.4 | 2.0 | 60 | FIG. 4 | 84 | 1.4 | 96 | 1.6 |
| COMPARATIVE EXAMPLE 1 | COMMON POLYESTER | 80 | 20 | 160 | 1.1 | 1.2 | 60 | FIG. 3 | 84 | 1.4 | 96 | 1.6 |
| COMPARATIVE EXAMPLE 2 | COMMON POLYESTER | 80 | 20 | 160 | 1.1 | 1.2 | 60 | FIG. 3 | 72 | 1.2 | 120 | 2.0 |
| COMPARATIVE EXAMPLE 3 | POLYMERIC POLYESTER | 10 | 20 | 200 | 1.4 | 2.0 | 60 | FIG. 3 | 84 | 1.4 | 96 | 1.6 |
| COMPARATIVE EXAMPLE 4 | POLYMERIC POLYESTER | 10 | 20 | 200 | 1.4 | 2.0 | 60 | FIG. 3 | 72 | 1.2 | 110 | 1.8 |
| COMPARATIVE EXAMPLE 5 | COMMON POLYESTER | 80 | 20 | 160 | 1.1 | 1.2 | 60 | FIG. 1 | 72 | 1.2 | 50 | 0.8 |
| COMPARATIVE EXAMPLE 6 | COMMON POLYESTER | 80 | 20 | 160 | 1.1 | 1.2 | 60 | FIG. 1 | 84 | 1.4 | 40 | 0.7 |
| COMPARATIVE EXAMPLE 7 | POLYMERIC POLYESTER | 10 | 20 | 200 | 1.1 | 2.0 | 60 | FIG. 1 | 72 | 1.2 | 50 | 0.8 |
| COMPARATIVE EXAMPLE 8 | POLYMERIC POLYESTER | 10 | 20 | 200 | 1.1 | 2.0 | 60 | FIG. 1 | 72 | 1.2 | 30 | 0.5 |
| COMPARATIVE EXAMPLE 9 | COMMON POLYESTER | 80 | 20 | 160 | 1.1 | 1.2 | 60 | FIG. 2 | 72 | 1.2 | 84 | 1.4 |
| COMPARATIVE EXAMPLE 10 | COMMON POLYESTER | 80 | 20 | 160 | 1.1 | 1.2 | 60 | FIG. 2 | 84 | 1.2 | 96 | 1.6 |

TABLE 2-continued

| COATING MATERIAL EMPLOYED: UNDILUTED COATING MATERIAL | | | | | | | | | | | | |
|---|---|---|---|---|---|---|---|---|---|---|---|---|
| COMPARATIVE EXAMPLE 11 | POLYMERIC POLYESTER | 10 | 20 | 200 | 1.1 | 2.0 | 60 | FIG. 2 | 84 | 1.2 | 96 | 1.6 |
| COMPARATIVE EXAMPLE 12 | POLYMERIC POLYESTER | 10 | 20 | 200 | 1.1 | 2.0 | 60 | FIG. 2 | 96 | 1.6 | 100 | 1.7 |

| ④ METALING ROLLER | | ⑤ | PRESENCE/ABSENCE OF | | |
|---|---|---|---|---|---|
| PERIPHERAL SPEED m/min | PERIPHERAL SPEED RATIO ④ ÷ ① | GAP BETWEEN PICK-UP ROLLER AND DOCTOR BAR μ | MENISCUS BETWEEN METALING ROLLER AND PICK-UP ROLLER | ACTUAL DESSICATED FILM THICKNESS μ | APPEARANCE OF COATED PRODUCT |
| 20 | 0.33 | 49 | PRESENT | 19 | SATISFACTORY |
| 20 | 0.33 | 37 | PRESENT | 19 | SATISFACTORY |
| 15 | 0.25 | 35 | PRESENT | 20 | SATISFACTORY |
| 10 | 0.17 | 30 | PRESENT | 21 | SATISFACTORY |
| 3 | 0.05 | 50 | PRESENT | 21 | SATISFACTORY |
| 15 | 0.25 | 55 | PRESENT | 21 | SATISFACTORY |
| 15 | 0.25 | 40 | PRESENT | 20 | SATISFACTORY |
| 5 | 0.08 | 38 | PRESENT | 19 | SATISFACTORY |
| 5 | 0.08 | 33 | PRESENT | 20 | SATISFACTORY |
| — | — | 49 | ABSENT | 20 | COLOR IRREGULARITIES ON THE PICK-UP ROLLER RESULTING FROM COATING MATERIAL FLOW PATTERN |
| — | — | 30 | ABSENT | 25 | BUBBLING RESULTING FROM EXCESSIVE COATING FILM THICKNESS |
| — | — | 33 | ABSENT | 19 | COLOR IRREGULARITIES ON THE PICK-UP ROLLER RESULTING FROM COATING MATERIAL FLOW PATTERN |
| — | — | 25 | ABSENT | 24 | BUBBLING RESULTING FROM EXCESSIVE COATING FILM THICKNESS |
| — | — | — | ABSENT | 20 | LARGE AMOUNT OF ROPING BUBBLING RESULTING FROM ROPING PROJECTIONS |
| — | — | — | ABSENT | 24 | BUBBLING RESULTING FROM EXCESSIVE COATING FILM THICKNESS |
| — | — | — | ABSENT | 21 | MEDIUM AMOUNT OF ROPING |
| — | — | — | ABSENT | 25 | BUBBLING RESULTING FROM EXCESSIVE COATING FILM THICKNESS |
| 10 | 0.17 | — | ABSENT | 19 | MEDIUM AMOUNT OF ROPING |
| 5 | 0.08 | — | ABSENT | 20 | SMALL AMOUNT OF ROPING |
| 5 | 0.08 | — | ABSENT | 19 | MEDIUM AMOUNT OF ROPING |
| 3 | 0.05 | — | ABSENT | 26 | BUBBLING RESULTING FROM EXCESSIVE COATING FILM THICKNESS |

TABLE 3

| COATING MATERIAL EMPLOYED: COATING MATERIAL HAVING HIGH THIXOTROPY | | | | | | | | | | | | |
|---|---|---|---|---|---|---|---|---|---|---|---|---|
| | | | TARGET DESSICATED | COATING | | PIGMENT | ① STRIP | | ② COATING ROLLER | | ③ PICK-UP ROLLER | |
| | COATING MATERIAL TYPE | GLOSS | FILM THICKNESS μ | MATERIAL VISCOSITY (Sec) | TI VALUE | PARTICLE DIAMETER μ | PASSAGE SPEED m/min | COATING APPARATUS | PERIPHERAL SPEED m/min | PERIPHERAL SPEED RATIO ② ÷ ① | PERIPHERAL SPEED m/min | PERIPHERAL SPEED RATIO ③ ÷ ① |
| EMBODIMENT 1 | VINYL CHLORIDE PLASTISOL | 70 | 200 | 3,000 | 1.7 | 2.0 | 50 | FIG. 4 | 60 | 1.2 | 70 | 1.4 |
| EMBODIMENT 2 | VINYL CHLORIDE PLASTISOL | 70 | 200 | 3,000 | 1.7 | 2.0 | 60 | FIG. 4 | 72 | 1.2 | 84 | 1.4 |
| EMBODIMENT 3 | VINYL CHLORIDE PLASTISOL | 70 | 200 | 3,000 | 1.7 | 2.0 | 80 | FIG. 4 | 96 | 1.2 | 110 | 1.4 |
| COMPARATIVE EXAMPLE 1 | VINYL CHLORIDE PLASTISOL | 70 | 200 | 3,000 | 1.7 | 2.0 | 50 | FIG. 3 | 60 | 1.2 | 70 | 1.4 |
| COMPARATIVE EXAMPLE 2 | VINYL CHLORIDE PLASTISOL | 70 | 200 | 3,000 | 1.7 | 2.0 | 60 | FIG. 3 | 72 | 1.2 | 84 | 1.4 |
| COMPARATIVE EXAMPLE 3 | VINYL CHLORIDE PLASTISOL | 70 | 200 | 3,000 | 1.7 | 2.0 | 50 | FIG. 1 | 60 | 1.2 | 70 | 1.4 |
| COMPARATIVE EXAMPLE 4 | VINYL CHLORIDE PLASTISOL | 70 | 200 | 2,000 | 1.7 | 2.0 | 50 | FIG. 1 | 60 | 1.2 | 84 | 1.7 |
| COMPARATIVE EXAMPLE 5 | VINYL CHLORIDE PLASTISOL | 70 | 200 | 3,000 | 1.7 | 2.0 | 50 | FIG. 2 | 60 | 1.2 | 70 | 1.4 |
| COMPARATIVE EXAMPLE 6 | VINYL CHLORIDE PLASTISOL | 70 | 200 | 2,000 | 1.7 | 2.0 | 50 | FIG. 2 | 60 | 1.2 | 84 | 1.7 |

TABLE 3-continued

| COATING MATERIAL EMPLOYED: COATING MATERIAL HAVING HIGH THIXOTROPY | | | | | |
|---|---|---|---|---|---|
| ④ METALING ROLLER | | ⑤ | | | |
| PERIPHERAL SPEED m/min | PERIPHERAL SPEED RATIO ④ ÷ ① | GAP BETWEEN PICK-UP ROLLER AND DOCTOR BAR μ | PRESENCE/ABSENCE OF MENISCUS BETWEEN METALING ROLLER AND PICK-UP ROLLER | ACTUAL DESSICATED FILM THICKNESS μ | APPEARANCE OF COATED PRODUCT |
| 5 | 0.41 | 49 | PRESENT | 210 | SATISFACTORY |
| 8 | 0.13 | 37 | PRESENT | 200 | SATISFACTORY |
| 10 | 0.13 | 35 | PRESENT | 200 | SATISFACTORY |
| — | — | 49 | ABSENT | 210 | SATISFACTORY |
| — | — | 30 | ABSENT | 200 | SATISFACTORY |
| — | — | 33 | ABSENT | 210 | LARGE AMOUNT OF ROPING |
| — | — | 30 | ABSENT | 200 | MEDIUM AMOUNT OF ROPING |
| 10 | 0.20 | — | ABSENT | 210 | MEDIUM AMOUNT OF ROPING |
| 5 | 0.10 | — | ABSENT | 200 | SMALL AMOUNT OF ROPING |

TABLE 4

| COATING MATERIAL EMPLOYED: COATING MATERIAL TO WHICH AGGREGATE AND A POWDER WERE ADDED | | | | | | | | | | | | |
|---|---|---|---|---|---|---|---|---|---|---|---|---|
| | | | TARGET DESSICATED | COATING | | PIGMENT | ① STRIP | | ② COATING ROLLER | | ③ PICK-UP ROLLER | |
| | COATING MATERIAL TYPE | GLOSS | FILM THICKNESS μ | MATERIAL VISCOSITY (Sec) | TI VALUE | PARTICLE DIAMETER μ | PASSAGE SPEED m/min | COATING APPARATUS | PERIPHERAL SPEED m/min | PERIPHERAL SPEED RATIO ② ÷ ① | PERIPHERAL SPEED m/min | PERIPHERAL SPEED RATIO ③ ÷ ① |
| EMBODIMENT 1 | POLYMERIC POLYESTER | 5 | 15 | 130 | 1.2 | A1 POWDER: 10 | 60 | FIG. 4 | 90 | 1.5 | 120 | 2.0 |
| EMBODIMENT 2 | POLYMERIC POLYESTER | 5 | 15 | 130 | 1.2 | A1 POWDER: 10 | 40 | FIG. 4 | 60 | 1.5 | 84 | 2.1 |
| EMBODIMENT 3 | COMMON POLYESTER | 5 | 15 | 130 | 1.2 | A1 POWDER: 10 | 40 | FIG. 4 | 60 | 1.5 | 84 | 2.1 |
| EMBODIMENT 4 | COMMON POLYESTER | 5 | 15 | 130 | 1.2 | A1 POWDER: 10 | 40 | FIG. 4 | 80 | 2.0 | 100 | 2.5 |
| EMBODIMENT 5 | POLYMERIC POLYESTER | 5 | 15 | 100 | 1.3 | AGGREGATE: 20 | 60 | FIG. 4 | 90 | 1.5 | 120 | 2.0 |
| EMBODIMENT 6 | POLYMERIC POLYESTER | 5 | 15 | 100 | 1.3 | AGGREGATE: 20 | 40 | FIG. 4 | 60 | 1.5 | 84 | 2.1 |
| EMBODIMENT 7 | COMMON POLYESTER | 5 | 15 | 100 | 1.3 | AGGREGATE: 20 | 40 | FIG. 4 | 60 | 1.5 | 84 | 2.1 |
| EMBODIMENT 8 | COMMON POLYESTER | 5 | 15 | 100 | 1.3 | AGGREGATE: 20 | 40 | FIG. 4 | 80 | 2.0 | 100 | 2.5 |
| EMBODIMENT 9 | POLYMERIC POLYESTER | 5 | 15 | 110 | 1.5 | AGGREGATE: 40 | 40 | FIG. 4 | 48 | 1.2 | 60 | 1.5 |
| EMBODIMENT 10 | COMMON POLYESTER | 5 | 15 | 110 | 1.5 | AGGREGATE: 40 | 40 | FIG. 4 | 40 | 1.0 | 48 | 1.2 |
| COMPARATIVE EXAMPLE 1 | POLYMERIC POLYESTER | 5 | 15 | 130 | 1.2 | A1 POWDER: 10 | 60 | FIG. 3 | 90 | 1.5 | 120 | 2.0 |
| COMPARATIVE EXAMPLE 2 | POLYMERIC POLYESTER | 5 | 15 | 130 | 1.2 | A1 POWDER: 10 | 40 | FIG. 3 | 60 | 1.5 | 84 | 2.1 |
| COMPARATIVE EXAMPLE 3 | COMMON POLYESTER | 5 | 15 | 130 | 1.2 | A1 POWDER: 10 | 40 | FIG. 3 | 60 | 1.5 | 100 | 2.5 |
| COMPARATIVE EXAMPLE 4 | POLYMERIC POLYESTER | 5 | 15 | 100 | 1.3 | AGGREGATE: 20 | 60 | FIG. 3 | 90 | 1.5 | 120 | 2.0 |
| COMPARATIVE EXAMPLE 5 | POLYMERIC POLYESTER | 5 | 15 | 100 | 1.3 | AGGREGATE: 20 | 40 | FIG. 3 | 60 | 1.5 | 100 | 2.5 |
| COMPARATIVE EXAMPLE 6 | COMMON POLYESTER | 5 | 15 | 100 | 1.3 | AGGREGATE: 20 | 40 | FIG. 3 | 60 | 1.5 | 100 | 2.5 |
| COMPARATIVE EXAMPLE 7 | POLYMERIC POLYESTER | 5 | 15 | 80 | 1.2 | A1 POWDER: 10 | 40 | FIG. 1 | 60 | 1.5 | 84 | 2.1 |
| COMPARATIVE EXAMPLE 8 | COMMON POLYESTER | 5 | 15 | 80 | 1.2 | A1 POWDER: 10 | 40 | FIG. 1 | 60 | 1.5 | 100 | 2.5 |
| COMPARATIVE EXAMPLE 9 | POLYMERIC POLYESTER | 5 | 15 | 100 | 1.3 | AGGREGATE: 20 | 40 | FIG. 1 | 60 | 1.5 | 84 | 2.1 |
| COMPARATIVE EXAMPLE 10 | COMMON POLYESTER | 5 | 15 | 100 | 1.3 | AGGREGATE: 20 | 40 | FIG. 1 | 60 | 1.5 | 100 | 2.5 |
| COMPARATIVE EXAMPLE 11 | COMMON POLYESTER | 5 | 15 | 100 | 1.2 | A1 POWDER: 10 | 40 | FIG. 2 | 60 | 1.5 | 84 | 2.1 |

TABLE 4-continued

| COATING MATERIAL EMPLOYED: COATING MATERIAL TO WHICH AGGREGATE AND A POWDER WERE ADDED | | | | | | | | | | | | |
|---|---|---|---|---|---|---|---|---|---|---|---|---|
| COMPARATIVE EXAMPLE 12 | COMMON POLYESTER | 5 | 15 | 80 | 1.3 | AGGREGATE: 20 | 40 | FIG. 2 | 60 | 1.5 | 90 | 2.0 |
| ④ METALING ROLLER | | | ⑤ | | PRESENCE/ABSENCE OF | | | | | | | |
| PERIPHERAL SPEED m/min | PERIPHERAL SPEED RATIO ④ ÷ ① | | GAP BETWEEN PICK-UP ROLLER AND DOCTOR BAR μ | | MENISCUS BETWEEN METALING ROLLER AND PICK-UP ROLLER | | ACTUAL DESSICATED FILM THICKNESS μ | | APPEARANCE OF COATED PRODUCT | | | |
| 5 | 0.08 | | 20 | | PRESENT | | 16 | | SATISFACTORY | | | |
| 10 | 0.25 | | 22 | | PRESENT | | 15 | | SATISFACTORY | | | |
| 5 | 0.08 | | 22 | | PRESENT | | 15 | | SATISFACTORY | | | |
| 5 | 0.13 | | 18 | | PRESENT | | 16 | | SATISFACTORY | | | |
| 10 | 0.08 | | 25 | | PRESENT | | 16 | | SATISFACTORY | | | |
| 10 | 0.08 | | 22 | | PRESENT | | 14 | | SATISFACTORY | | | |
| 15 | 0.38 | | 22 | | PRESENT | | 15 | | SATISFACTORY | | | |
| 5 | 0.13 | | 21 | | PRESENT | | 16 | | SATISFACTORY | | | |
| 5 | 0.13 | | 50 | | PRESENT | | 16 | | SATISFACTORY | | | |
| 5 | 0.13 | | 60 | | PRESENT | | 17 | | SATISFACTORY | | | |
| — | — | | 20 | | ABSENT | | 16 | | COLOR IRREGULARITIES ON PICK-UP ROLLER | | | |
| — | — | | 22 | | ABSENT | | 15 | | COLOR IRREGULARITIES | | | |
| — | — | | 20 | | ABSENT | | 20 | | BUBBLING RESULTING FROM EXCESSIVE COATING FILM THICKNESS | | | |
| — | — | | 25 | | ABSENT | | 14 | | COLOR IRREGULARITIES | | | |
| — | — | | 22 | | ABSENT | | 21 | | BUBBLING RESULTING FROM EXCESSIVE COATING FILM THICKNESS | | | |
| — | — | | 15 | | ABSENT | | 15 | | AGGREGATE CAUGHT BETWEEN DOCTOR BAR AND PICK-UP ROLLER, LINEAR FLAWS RESULT | | | |
| — | — | | — | | ABSENT | | 15 | | ROPING AND COLOR IRREGULARITIES | | | |
| — | — | | — | | ABSENT | | 14 | | MEDIUM AMOUNT OF ROPING | | | |
| — | — | | — | | ABSENT | | 20 | | LARGE AMOUNT OF ROPING AND COLOR IRREGULARITIES | | | |
| — | — | | — | | ABSENT | | 15 | | MEDIUM AMOUNT OF ROPING AND COLOR IRREGULARITIES | | | |
| 10 | 0.25 | | — | | ABSENT | | 15 | | MEDIUM AMOUNT OF ROPING AND COLOR IRREGULARITIES | | | |
| 10 | 0.25 | | — | | ABSENT | | 14 | | MEDIUM AMOUNT OF ROPING AND COLOR IRREGULARITIES | | | |

*: A1 POWDER → MAXIMUM THICKNESS
AGGREGATE → MAXIMUM DIAMETER

Industrial Applicability

By means of a coating apparatus using the reverse roller coater method employing a doctor bar in accordance with the present invention, it is possible to produce products having a smooth external coating appearance without coating film defects even if any type of a coating material is used, irrespective of characteristics such as the thixotropic characteristics or pick-up characteristics of the coating material.

Furthermore, since the characteristics of the coating material do not come into question, the range of coating characteristics is broader than that of conventional apparatuses, and it is possible to conduct continuous coating having superior operability in a stable manner.

We claim:

1. A continuous coating method for uniformly coating a coating material on a substrate, comprising:

arranging a pick-up roller, a coating roller, a metering roller and a doctor bar parallel to each other such that the pick-up roller is disposed between the coating roller and the metering roller and the doctor bar is located above the pick-up roller, said coating roller being located in proximity to the substrate, rotating the pick-up roller in a direction to pick-up the coating material through a gap between the pick-up roller and the metering roller, rotating the metering roller in a same direction as the pick-up roller at a nip of these rollers, and rotating the coating roller in a reverse direction with respect to the pick-up roller at a nip of these rollers, said substrate travelling in a reverse direction with respect to the coating roller at a nip thereof, providing the coating material to the pick-up roller so that the pick-up roller picks up the coating material through the gap between the pick-up roller and the metering roller, and forming a meniscus of the coating material between the pick-up roller and the metering roller while the pick-up roller and the metering roller are rotating, to thereby form a uniform coating film on the pick-up roller, which is transferred to the substrate through the coating roller.

2. A continuous coating method according to claim 1, wherein an amount of the meniscus generally held between the pick-up roller and the metering roller is set at least 1.5 times relative to an amount of the coating material passing through a gap between the doctor bar and the pick-up roller.

3. A continuous coating method according to claim 2, wherein a rotational speed of the pick-up roller is set within a range of 1.0–2.5 times relative to a travelling speed of the substrate, and the amount of the meniscus is regulated by adjusting a rotational speed of the metering roller.

* * * * *